US011542666B2

(12) United States Patent
Philipp

(10) Patent No.: US 11,542,666 B2
(45) Date of Patent: Jan. 3, 2023

(54) METHOD AND DEVICE FOR COMPACTING A TRACK BALLAST BED

(71) Applicant: PLASSER & THEURER EXPORT VON BAHNBAUMASCHINEN GESELLSCHAFT MBH, Vienna (AT)

(72) Inventor: Thomas Philipp, Leonding (AT)

(73) Assignee: Plasser & Theurer Export von Bahnbaumaschinen Gesellschaft m.b.H., Vienna (AT)

( * ) Notice: Subject to any disclaimer, the term of this patent is extended or adjusted under 35 U.S.C. 154(b) by 419 days.

(21) Appl. No.: 16/628,758

(22) PCT Filed: Jun. 6, 2018

(86) PCT No.: PCT/EP2018/064849
§ 371 (c)(1),
(2) Date: Jan. 6, 2020

(87) PCT Pub. No.: WO2019/007621
PCT Pub. Date: Jan. 10, 2019

(65) Prior Publication Data

US 2020/0141063 A1 May 7, 2020

(30) Foreign Application Priority Data

Jul. 4, 2017 (AT) ..... A 279/2017

(51) Int. Cl.
*E01B 27/16* (2006.01)

(52) U.S. Cl.
CPC ..... *E01B 27/16* (2013.01); *E01B 2203/12* (2013.01)

(58) Field of Classification Search
CPC ..... E01B 27/16; E01B 27/17; E01B 27/20; E01B 35/00; E01B 35/02; E01B 35/06; E01B 35/08; E01B 35/10; E01B 35/12; E01B 2203/10; E01B 2203/12; E01B 2203/122; E01B 2203/127
See application file for complete search history.

(56) References Cited

U.S. PATENT DOCUMENTS 3,981,247 A * 9/1976 Theurer ..... E01B 27/16 104/12
4,458,600 A 7/1984 Hurni
9,957,668 B2 * 5/2018 Lichtberger ..... E01B 27/16
(Continued)

FOREIGN PATENT DOCUMENTS

AT 339358 A 10/1977
AT 500972 B1 5/2006
(Continued)

*Primary Examiner* — Zachary L Kuhfuss
*Assistant Examiner* — Cheng Lin
(74) *Attorney, Agent, or Firm* — Laurence A. Greenberg; Werner H. Stemer; Ralph E. Locher

(57) ABSTRACT

A method performs compaction of a track ballast bed by use of a tamping unit having two oppositely positioned tamping tools which, actuated with a vibration, are lowered into the track ballast bed during a tamping operation and moved towards one another with a squeezing motion. In this, it is provided that at least one variable vibration parameter is specified in dependence on a duration of penetration into the track ballast bed, until a required penetration depth of the tamping tools has been reached.

10 Claims, 2 Drawing Sheets

(56) References Cited

U.S. PATENT DOCUMENTS

| | | | | |
|---|---|---|---|---|
| 10,208,432 | B2 * | 2/2019 | Seyrlehner | B06B 1/18 |
| 10,421,101 | B2 * | 9/2019 | Hoefler | E01B 27/16 |
| 11,255,055 | B2 * | 2/2022 | Buerger | E01B 35/00 |
| 2006/0090666 | A1 * | 5/2006 | Theurer | E01B 27/16 104/12 |
| 2015/0233062 | A1 | 8/2015 | Springer | |
| 2018/0298565 | A1 * | 10/2018 | Seyrlehner | B06B 1/162 |
| 2019/0055698 | A1 * | 2/2019 | Hofstaetter | E01B 27/13 |

FOREIGN PATENT DOCUMENTS

| | | | |
|---|---|---|---|
| AT | 513973 | B1 | 9/2014 |
| AT | 515801 | B1 | 12/2015 |
| AT | 517999 | A1 | 6/2017 |
| CN | 1766231 | A | 5/2006 |
| CN | 200958192 | Y | 10/2007 |
| CN | 101481895 | A | 7/2009 |
| DE | 3144485 | A1 | 6/1982 |

* cited by examiner

METHOD AND DEVICE FOR COMPACTING A TRACK BALLAST BED

A method and device for compaction of a track ballast bed

BACKGROUND OF THE INVENTION

Field of the Invention

The invention relates to a method for compaction of a track ballast bed by means of a tamping unit comprising two oppositely positioned tamping tools which, actuated with a vibration, are lowered into the track ballast bed during a tamping operation and moved towards one another with a squeezing motion. In addition, the invention relates to a device for performing the method.

Tamping units for tamping sleepers are already well known, such as, for example, from AT 500 972 B1 or AT 513 973 B1. Vibrations acting upon the tamping tools can be generated either mechanically by an eccentric shaft or by hydraulic impulses in a linear motor.

AT 515 801 B1 describes a method for compaction of a track ballast bed by means of a tamping unit, wherein a quality figure for a ballast bed hardness is to be shown. To that end, a squeezing force of a squeezing cylinder is recorded in dependence on a squeezing path and, by way of an energy consumption derived from this, a characteristic figure is defined. However, this characteristic figure is of little informative value since a significant energy portion, which is getting lost in the system, is not taken into account. In addition, the total energy actually introduced into the ballast during a tamping operation would still not allow a reliable evaluation of a ballast bed condition. Furthermore, for determining an energy-optimal amplitude or frequency, the permanent way must first be identified, which has a very time- and cost intensive effect on the tamping procedure.

SUMMARY OF THE INVENTION

It is the object of the invention to provide an improvement over the prior art for a method and a device of the type mentioned at the beginning.

According to the invention, this object is achieved by way of a method according to the independent method claim and a device according to the independent device claim. Dependent claims indicate advantageous embodiments of the invention.

The method is characterized in that at least one variable vibration parameter is specified in dependence on a duration of penetration into the track ballast bed, until a required penetration depth of the tamping tools has been reached. In this manner, an energy-optimized penetration of the tamping tools is achieved. In this, the vibration parameter changes automatically with increasing penetration duration, so that the penetration procedure is always matched to the actual ballast bed conditions. Thus, no identification of a permanent way and of its bed hardness or resistance is initially necessary. Rather, a conclusion as to the bed hardness is drawn on the basis of the penetration duration.

To that end, in a simple embodiment of the method, the vibration parameter is changed by way of a chart and/or curve stored in a control system. With this, a quick adaptation of the vibration parameter can take place with little computing power.

It is additionally advantageous if the specified dependence of the vibration parameter on the duration of penetration is changed in real time. In this manner, it is possible to react quickly to particular conditions in that, for example, a more rapid increase of the vibration parameter with increasing penetration duration takes place. Additionally, an operator of the working machine always has the possibility to optimize in real time specifications for a tamping operation.

Advantageously, an increasing amplitude is specified as vibration parameter. In the case of a loose ballast bed (new layer) with low resistance, a small amplitude suffices for the penetration by the tamping tools. With this loose ballast bed, an increase of the amplitude is not necessary. The mass of the tamping unit is sufficient to lower the tamping tools to a required working depth. In the case of a hard ballast bed (long service life), the penetration by the tamping tools takes longer due to a higher resistance of the ballast. The amplitude is increased in dependence on the penetration duration in order to counteract the higher penetration resistance and to overcome the same.

A further improvement provides that a variable frequency or is specified as vibration parameter. A dependence of the frequency on the penetration duration has an energy-optimizing effect on the tamping unit. For example, a smaller frequency can be maintained in the case of a loose ballast bed. The frequency and thus the energy to be expended are only increased with increasing penetration duration only for a hard ballast bed.

Additionally it is advantageous if the duration of penetration and an energy expended for the penetration into the track ballast bed are recorded in an evaluation device. As a result of a recording of the required energy during each penetration procedure, a simple documentation exists which can be used for further optimization of the maintenance intervals.

The device according to the invention for performing one of the afore-mentioned methods comprises a tamping unit having two oppositely positioned tamping tools which are each coupled via a pivot arm to a squeezing drive and a vibration drive, wherein a dependence of at least one vibration parameter on a duration of penetration is specified in a control system.

In this, it is advantageous if an evaluation device is provided for recording the duration of penetration and/or an energy expended. By recording and evaluating, an energy balance of the tamping unit is continually improved.

An additional further development of the device provides that the control system is designed as an intelligent control in order to automatically adapt the specified dependence of the vibration parameter on the duration of penetration for energy optimization. An intelligent control can be designed to be capable of learning, for example, in order to include previously recorded tamping operations in the energy optimization.

It is additionally advantageous if the control system is coupled to an operating unit for changing in real time the specified dependence of the vibration parameter on the duration of penetration. Thus, the operator still has the possibility during each tamping procedure to intervene in controlling the tamping unit and thus in the tamping operation.

BRIEF DESCRIPTION OF THE DRAWINGS

The invention will be described below by way of example with reference to the accompanying drawings. There is shown in a schematic manner in:

BRIEF DESCRIPTION OF THE SEVERAL VIEWS OF THE DRAWING

Figure 1:
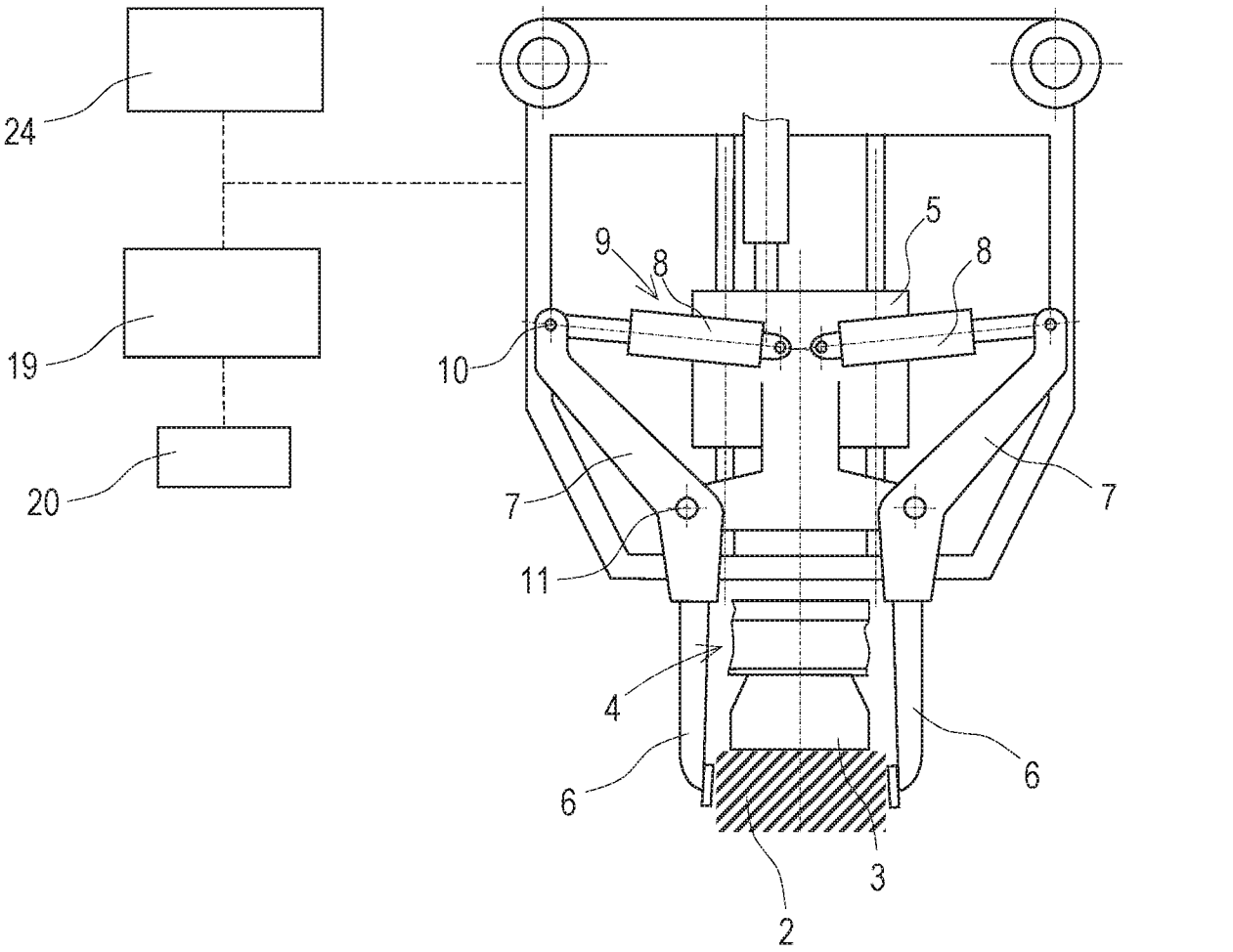

FIG. 1 a tamping unit

Figure 2:
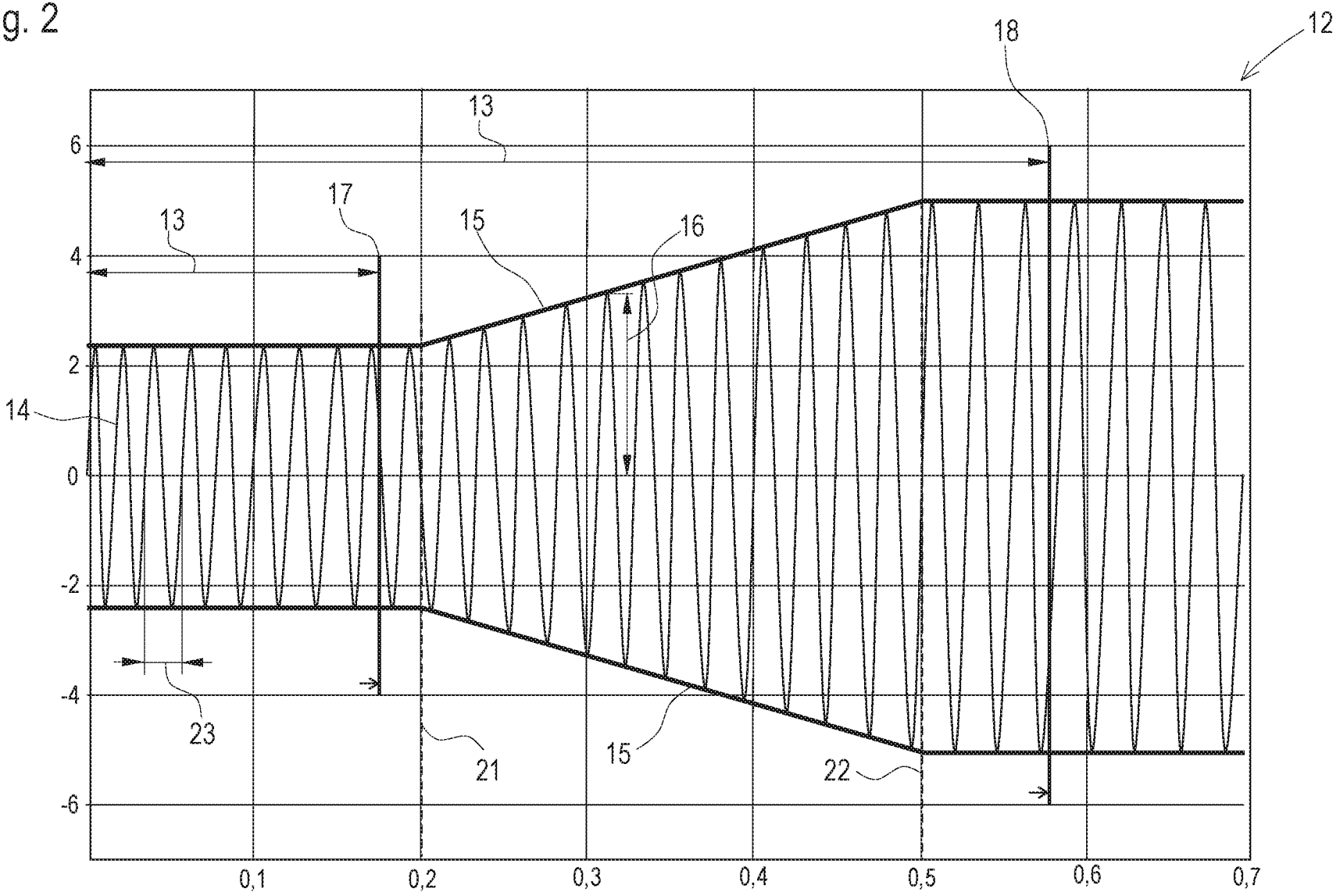

FIG. 2 a diagram of optimized penetration behaviour

DESCRIPTION OF THE INVENTION

FIG. 1 shows a tamping unit 1, represented in a simplified way, for tamping a track ballast bed 2 underneath sleepers 3 of a track 4, having a lowerable tool carrier 5 and pairs of two oppositely positioned tamping tools 6. Each tamping tool 6 is connected via a pivot arm 7 to a hydraulic squeezing drive 8 which simultaneously serves as a vibration drive 9. The pivot arm 7 in each case has an upper pivot axis 10 on which the squeezing drive 8 is supported. The respective pivot arm 7 is mounted on the tool carrier 5 for rotation about a lower pivot axis 11. Such a tamping unit 1 is intended for installation in a track tamping machine mobile on the track 4, or in a tamping satellite.

Shown in FIG. 2 in a diagram 12 is a vibration progression of a tamping tool 6 during a penetration procedure. The penetration duration 13 is shown on the abscissa axis. The ordinate axis indicates values for the vibration swings 14 (vibration) of the tamping tools 6. An envelope curve 15 of the vibration swings 14 shows a progression of the vibration amplitude 16. In the present example, this curve 15 shows the amplitude 16 being dependent as variable vibration parameter on the penetration duration 13.

Specifically, the amplitude 16 is increased in dependence on the penetration duration 13 on the basis of the curve 15 until the required penetration depth has been attained (the amplitude 16 is a function of the penetration duration 13). In this manner, the energy-optimal vibration amplitude 16 is automatically pre-set in dependence on the penetration duration 13 and thus on the resistance of the ballast bed 2. It is not necessary to identify beforehand the permanent way and the bed hardness thereof. The curve 15 shown in FIG. 2 shows a linear progression, for example.

In the diagram, two vertical lines 17, 18 each show an attaining of the prescribed penetration depth. The first vertical line 17 corresponds to a loose ballast bed 2 with low resistance. Here, the penetration operation is already finished after a short penetration duration 13 while maintaining a small vibration amplitude 16.

The second vertical line 18 corresponds to a hard ballast bed 2 with high resistance. Over the longer penetration duration 13, the amplitude 16 increases in correspondence with the curve 15 until the penetration procedure is finished at maximum swing of the tamping tools 6. In the case of a harder ballast bed 2, the penetration procedure takes longer, and thus the optimal amplitude 16 is pre-set automatically.

For example, the curve 15 is stored in a storage unit of a control system 19 as a function or in tabular form. Also, several curves 15 can be stored wherein, via an operating unit 20, a choice is made or a change of parameters can be carried out. With an intelligent control it is possible to make adaptations of the pre-set curve 15 automatically in real time. In this, for example, currently executed penetration procedures are evaluated in order to optimize the energy expenditure for the penetration by the tamping tools 6. Conclusions as to the condition of the ballast bed 2 are also possible.

The adaptation of the pre-set curve 15 can also concern the shape. For example, an increase beginning 21 and an increase end 22 of a linear increase of the vibration amplitude 16 can be shifted. Non-linear changes of the vibration parameters can also be useful in order to react to prevailing conditions in an optimal way (for example, sinus-shaped increase). In addition, change specifications matched to one another for the amplitude 16 and the frequency or period duration 23 are expedient for optimizing the vibration motion of the tamping tools 6 during a penetration procedure.

To that end, the device comprises an evaluation device 24 coupled to the control system 19. By means of this evaluation device 24, for example, the energy required for a penetration procedure is determined. In this, in the case of hydraulic vibration generation by means of squeezing cylinders, the following relationship for the mechanical performance applies:

$$P_{mech}=p_0 \cdot Q$$

$p_0$ . . . hydraulic supply pressure [bar]

Q . . . required volume stream of the squeezing cylinders $$\left[\frac{m^3}{s}\right]$$

The volume stream of the squeezing cylinders can be assessed with the following formula:

$$Q=(A_A+A_B)\cdot a\cdot f$$

$A_A$ . . . large area of the squeezing cylinder, [$m^2$]

$A_B$ . . . small area of the squeezing cylinder, [$m^2$]

a . . . amplitude 16 of the squeezing cylinder, [m]

f . . . frequency of the vibration motion, $$\left[\frac{1}{s}\right]$$

The required energy for the penetration per penetration procedure then results as follows:

$$W_{ed}=\int_{t_0}^{t_{tauch}} P_{mech}\cdot dt=\int_{t_0}^{t_{tauch}} p_0\cdot(A_A+A_B)\cdot a\cdot f\cdot dt$$

$t_0$ . . . beginning of penetration duration 13 [s]

$t_{tauch}$ . . . end of penetration duration 13 [s]

With tamping units having an eccentric drive for vibration generation, the vibration frequency can initially be specified in the above-described manner. In variants with adjustable vibration amplitude 16, the same can also be specified in dependence on the penetration duration 13 (see the Austrian Patent Application with the file number A 60/2017 of the applicant, or the Application AT 517 999 A1).

The invention claimed is:

1. A method for compaction of a track ballast bed, which comprises the steps of:

providing a tamping unit having two oppositely positioned tamping tools which, actuated with a vibration, are lowered into the track ballast bed during a tamping operation and move towards one another with a squeezing motion; and specifying a progression of at least one variable vibration parameter by means of a control system in dependence on a duration of penetration of the tamping tools into the track ballast bed and that the at least one variable vibration parameter is changed automatically during a penetration operation with an increasing duration of penetration until a required penetration depth of the tamping tools has been reached.

2. The method according to claim 1, which further comprises changing the variable vibration parameter by way of a chart and/or curve stored in the control system.

3. The method according to claim 1, wherein a specified dependence of the variable vibration parameter on the duration of penetration is changed in real time.

4. The method according to claim 1, wherein an increasing amplitude is specified as the variable vibration parameter.

5. The method according to claim 1, wherein a variable frequency or period time is specified as the variable vibration parameter.

6. The method according to claim 1, which further comprises recording the duration of penetration and an energy expended for penetration into the track ballast bed in an evaluation device.

7. A device for compacting a track ballast bed, the device comprising:

a control system;

a tamping unit having pivot arms, squeezing drives functioning as vibration drives, and two oppositely positioned tamping tools which are each coupled via one of said pivot arms to one of said squeezing drives; and said control system specifying a progression of at least one vibration parameter in dependence on a duration of penetration of said tamping tools into the track ballast bed and that the at least one vibration parameter is changed automatically during a penetration operation with an increasing duration of penetration until a required penetration depth of said tamping tools has been reached.

8. The device according to claim 7, further comprising an evaluation device for recording the duration of penetration and/or energy expended.

9. The device according to claim 7, wherein said control system is configured as an intelligent controller in order to automatically adapt a specified dependence of the vibration parameter on the duration of penetration for energy optimization.

10. The device according to claim 7, further comprising an operating unit, said control system is coupled to said operating unit for changing in real time a specified dependence of the vibration parameter on the duration of penetration.

* * * * *